US007610838B2

(12) United States Patent
Kent et al.

(10) Patent No.: US 7,610,838 B2
(45) Date of Patent: Nov. 3, 2009

(54) HOLE PUNCH

(75) Inventors: Michael Kent, Cumberland, RI (US); William D. Hester, Meriden, CT (US); Kenneth Zins, Fitchburg, MA (US); Chinawut Paesang, Cumberland, RI (US)

(73) Assignee: Staples The Office Superstore, LLC, Framingham, MA (US)

( * ) Notice: Subject to any disclaimer, the term of this patent is extended or adjusted under 35 U.S.C. 154(b) by 230 days.

(21) Appl. No.: 11/731,785

(22) Filed: Mar. 30, 2007

(65) Prior Publication Data

US 2008/0236353 A1 Oct. 2, 2008

(51) Int. Cl.
*B26D 5/08* (2006.01)

(52) U.S. Cl. ..... 83/618; 83/620; 83/633; 83/684

(58) Field of Classification Search ..... 83/684, 83/563, 618, 620, 633, 634, 687, 691, 588
See application file for complete search history.

(56) References Cited

U.S. PATENT DOCUMENTS

| | | | |
|---|---|---|---|
| 332,666 | A | 12/1885 | Laney |
| 2,200,672 | A | 5/1940 | Kern |
| 2,382,523 | A | 8/1945 | Unger |
| 2,587,749 | A | 3/1952 | Misson |
| 3,005,371 | A | 10/1961 | Misson |
| 3,492,901 | A | 2/1970 | Smith |
| 3,714,857 | A | 2/1973 | Stuertz et al. |
| 3,750,514 | A | 8/1973 | Tanaka |
| 3,906,633 | A | 9/1975 | Inoue |
| 3,921,487 | A | 11/1975 | Otsuka et al. |
| 4,036,088 | A | 7/1977 | Ruskin |
| 4,166,404 | A | 9/1979 | Almog |
| 4,210,048 | A | 7/1980 | Cohler et al. |

(Continued)

FOREIGN PATENT DOCUMENTS

| | | | |
|---|---|---|---|
| DE | 925 110 | C | 3/1955 |

(Continued)

OTHER PUBLICATIONS

International Searching Authority "Invitation to Pay Additional Fees and Partial International Search Report" PCT Apln. No. US2007/007922 mailed Sep. 25, 2007.

(Continued)

*Primary Examiner*—Boyer D Ashley
*Assistant Examiner*—Omar Flores-Sánchez
(74) *Attorney, Agent, or Firm*—Wolf, Greenfield & Sacks, P.C.

(57) ABSTRACT

A hole punch includes a base and a lever system to actuate a punch. The lever system includes a first lever having an end pivotally connected to the first end of the base and a second lever having an end pivotally connected to the second end of the base. Actuation of a free end of the second lever causes the first lever to move. In one embodiment, a lock is operatively coupled to the lever system and engages the first and second levers to hold the levers in a stowed position. In another embodiment, the hole punch includes a third lever having a first end operatively coupled to the first lever and a second end operatively coupled to the second lever.

31 Claims, 9 Drawing Sheets

U.S. PATENT DOCUMENTS

| | | | | |
|---|---|---|---|---|
| 4,421,000 | A | 12/1983 | Murphy | |
| 4,466,322 | A | 8/1984 | Mori | |
| 4,499,805 | A | 2/1985 | Mori | |
| 4,509,396 | A | 4/1985 | Schall et al. | |
| 4,688,457 | A | 8/1987 | Neilsen et al. | |
| 4,700,601 | A | 10/1987 | Simon | |
| 4,713,995 | A | 12/1987 | Davi | |
| 4,763,552 | A | 8/1988 | Wagner | |
| 4,823,661 | A | 4/1989 | Freres | |
| 4,829,867 | A | 5/1989 | Neilsen | |
| 4,833,958 | A | 5/1989 | Abildgaard et al. | |
| 4,898,055 | A | 2/1990 | Neilsen | |
| 4,949,449 | A | 8/1990 | Wilson | |
| 4,987,683 | A | 1/1991 | Brych | |
| 5,007,782 | A | 4/1991 | Groswith, III et al. | |
| 5,040,441 | A | 8/1991 | Tamura | |
| 5,044,239 | A | 9/1991 | Endo et al. | |
| D320,407 | S | 10/1991 | Lathrop, Jr. et al. | |
| D330,049 | S | 10/1992 | Lathrop, Jr. et al. | |
| 5,162,250 | A | 11/1992 | Clark | |
| 5,163,350 | A | 11/1992 | Groswith, III et al. | |
| 5,247,863 | A | 9/1993 | Cohen | |
| 5,273,387 | A | 12/1993 | Groswith, III et al. | |
| 5,291,813 | A | 3/1994 | Blumenthal et al. | |
| 5,297,343 | A * | 3/1994 | Melter et al. | 30/262 |
| D350,564 | S | 9/1994 | Goodin | |
| 5,386,638 | A | 2/1995 | Weber | |
| 5,409,319 | A | 4/1995 | Bedol | |
| D361,786 | S | 8/1995 | Yang | |
| 5,501,128 | A | 3/1996 | D'Amore | |
| 5,575,188 | A | 11/1996 | Hu | |
| 5,584,124 | A | 12/1996 | Marthaler et al. | |
| 5,601,006 | A | 2/1997 | Quinn et al. | |
| 5,611,254 | A | 3/1997 | Rall | |
| D379,475 | S | 5/1997 | Mangler | |
| 5,632,188 | A | 5/1997 | Karlis | |
| 5,730,038 | A | 3/1998 | Evans et al. | |
| 5,740,712 | A | 4/1998 | Watkins et al. | |
| 5,778,750 | A | 7/1998 | Drzewiecki et al. | |
| 5,787,783 | A | 8/1998 | Evans et al. | |
| 5,797,308 | A | 8/1998 | Evans et al. | |
| 5,829,334 | A | 11/1998 | Evans et al. | |
| 5,832,798 | A | 11/1998 | Schneider et al. | |
| 5,894,778 | A | 4/1999 | Mori | |
| 6,032,566 | A | 3/2000 | Evans et al. | |
| 6,079,924 | A | 6/2000 | Chiang | |
| 6,109,155 | A | 8/2000 | Huang | |
| 6,119,555 | A | 9/2000 | DiMaria | |
| D445,832 | S | 7/2001 | Chan | |
| 6,439,093 | B1 | 8/2002 | Davies | |
| D468,360 | S | 1/2003 | Chen | |
| D468,772 | S | 1/2003 | Robillard | |
| 6,516,523 | B1 | 2/2003 | Lin | |
| D477,846 | S | 7/2003 | Racamier | |
| 6,655,250 | B1 | 12/2003 | Ishii et al. | |
| 6,688,199 | B2 | 2/2004 | Godston et al. | |
| D489,763 | S | 5/2004 | Chen | |
| D506,784 | S | 6/2005 | Bodum | |
| 6,983,877 | B2 | 1/2006 | Ko | |
| 7,032,490 | B2 | 4/2006 | Lee | |
| 7,036,416 | B2 | 5/2006 | Whiteman et al. | |
| 7,066,002 | B2 * | 6/2006 | Price et al. | 72/450 |
| 7,080,455 | B1 * | 7/2006 | Ronan et al. | 30/122 |
| D541,867 | S | 5/2007 | Kent et al | |
| D542,848 | S | 5/2007 | Kent et al. | |
| D543,243 | S | 5/2007 | Holliday | |
| 7,225,659 | B2 | 6/2007 | Tomita | |
| 7,275,323 | B2 * | 10/2007 | Yang | 30/244 |
| 2002/0066350 | A1 | 6/2002 | Chiang | |
| 2002/0157517 | A1 | 10/2002 | Huang | |
| 2003/0024361 | A1 | 2/2003 | Kikuchi | |
| 2003/0121384 | A1 | 7/2003 | Lin | |
| 2004/0069110 | A1 | 4/2004 | Godston et al. | |
| 2004/0237748 | A1 | 12/2004 | Potthoff et al. | |
| 2004/0244553 | A1 | 12/2004 | Rodriguez | |
| 2004/0244554 | A1 | 12/2004 | Rodriguez | |
| 2005/0056133 | A1 | 3/2005 | Huang | |
| 2005/0081695 | A1 | 4/2005 | Lee | |
| 2005/0105982 | A1 | 5/2005 | Case | |
| 2006/0048559 | A1 | 3/2006 | Huang | |
| 2006/0144206 | A1 | 7/2006 | Lee | |
| 2007/0044618 | A1 | 3/2007 | Marks | |
| 2007/0044623 | A1 | 3/2007 | Marks | |
| 2007/0044624 | A1 | 3/2007 | Marks | |

FOREIGN PATENT DOCUMENTS

| | | | |
|---|---|---|---|
| DE | 2017749 | | 10/1971 |
| DE | 90 11 500 | U1 | 11/1990 |
| DE | 10051625 | A1 | 5/2002 |
| EP | 0908327 | A2 | 4/1999 |
| EP | 1332845 | A2 | 8/2003 |
| EP | 1332848 | A2 | 8/2003 |
| EP | 1332849 | A2 | 8/2003 |
| EP | 1336458 | A2 | 8/2003 |
| FR | 686959 | | 8/1930 |
| GB | 134728 | | 11/1919 |
| GB | 631930 | | 11/1949 |
| GB | 740305 | | 11/1955 |
| GB | 783248 | | 9/1957 |
| GB | 2202178 | | 9/1988 |

OTHER PUBLICATIONS

International Searching Authority "International Search Report" and "Written Opinion" PCT Apln. No. US2007/007922 mailed Dec. 6, 2007.

* cited by examiner

HOLE PUNCH

FIELD

Aspects of the inventions relate to hole punches and more particularly to desk-top hole punches for punching holes through paper.

BACKGROUND

Hole punches are employed to punch holes through sheet paper to allow a user to place the sheet paper in a ring binder. Typically, the hole punch includes one or more punch heads acted upon by a lever, whereby actuation of the lever causes the punch heads to pierce through the paper and create a hole. As the stack of paper to be punched increases from one to many sheets, the effort necessary to punch the holes also increases. Hole punches exist where additional punching force can be applied through the provision of a longer lever. This solution, however, typically results in a relatively large hole punch, increasing the overall footprint or envelope of the hole punch, and rendering them less suitable for use in smaller work areas.

SUMMARY

Aspects of the invention are directed to improved hole punches, including hole punches that balance the need for increased leverage yet take up minimal amount of space.

According to one aspect of the invention, a hole punch is provided. The hole punch includes a base having a longitudinal axis, the base having a first end and a second end. The first lever has a first end pivotally connected to the first end of the base. The first lever is constructed and arranged to pivot about an axis that is substantially perpendicular to the longitudinal axis. A second lever has a first end pivotally connected to the second end of the base and a second free end. The second lever is constructed and arranged to pivot about an axis that is substantially perpendicular to the longitudinal axis. The second lever cooperates with the first lever such that actuation of the free end of the second lever causes the first lever to move. The hole punch further includes a third lever having a first end operatively coupled to the first lever and a second end operatively coupled to the second lever. At least one punch head is mounted to the base. The punch head has a punch, with the third lever adapted to engage the punch and move the punch from a rest position to a deployed position upon actuation of the free end of the second lever.

According to another aspect of the invention, a hole punch is provided. The hole punch has a base having a longitudinal axis and first and second ends. A lever system is movable from a pre-actuation position to punch position. The lever system includes a first lever having a first end pivotally connected to the first end of the base. The first lever is constructed and arranged to pivot about an axis that is substantially perpendicular to the longitudinal axis. A second lever having a first end is pivotally connected to the second end of the base and has a second free end. The second lever is constructed and arranged to pivot about an axis that is substantially perpendicular to the longitudinal axis. The second lever cooperates with the first lever such that actuation of the free end of the second lever causes the first lever to move. At least one punch head having a punch is mounted to the base and is operatively coupled to the lever system such that upon actuation of the lever system, the punch moves from a rest position to a deployed position. The hole punch further includes a lock operatively coupled to the lever system. The lock is constructed and arranged to engage with the first and second levers to hold the levers in a stowed position located at or between the pre-actuation position and the punch position.

According to yet another aspect of the invention, a hole punch is provided. The hole punch includes a base having a longitudinal axis. The base has a first upstanding portion at a first end of the base and a second upstanding portion at a second end of the base. A lever system is movable from a pre-actuation position to punch position. The lever system includes a first lever having a first end pivotally connected to the first upstanding portion. The first lever is constructed and arranged to pivot about an axis that is substantially perpendicular to the longitudinal axis. The first lever has a first flange near the first end of the first lever. The lever system further includes a second lever having a first end pivotally connected to the second upstanding portion and a second free end. The second lever is constructed and arranged to pivot about an axis that is substantially perpendicular to the longitudinal axis. The second lever has a second flange near the first end of the second lever. An underside surface of the second lever engages the first lever such that actuation of the free end of the second lever causes the first lever to move. A third lever has a first end connected to the first flange and a second end connected to the second flange. At least one punch head is mounted to the base and has a punch. The third lever is adapted to engage the punch and move the punch from a rest position to a deployed position upon actuation of the free end of the second lever. The hole punch further includes a lock operatively coupled to the lever system. The lock includes a hook disposed on the second lever and is constructed and arranged to engage a pocket disposed through the first lever to hold the levers in a stowed position located at or between the pre-actuation position and the punch position.

Various embodiments of the present invention provide certain advantages. Not all embodiments of the invention share the same advantages and those that do may not share them under all circumstances.

Further features and advantages of the present invention, as well as the structure of various embodiments of the present invention are described in detail below with reference to the accompanying drawings.

BRIEF DESCRIPTION OF THE DRAWINGS

The accompanying drawings are not intended to be drawn to scale. In the drawings, similar features are represented by like reference numerals. For purposes of clarity, not every component is labeled in every drawing. Various embodiments of the invention will now be described, by way of example, with reference to the accompanying drawings, in which.

DETAILED DESCRIPTION

Figure 1:
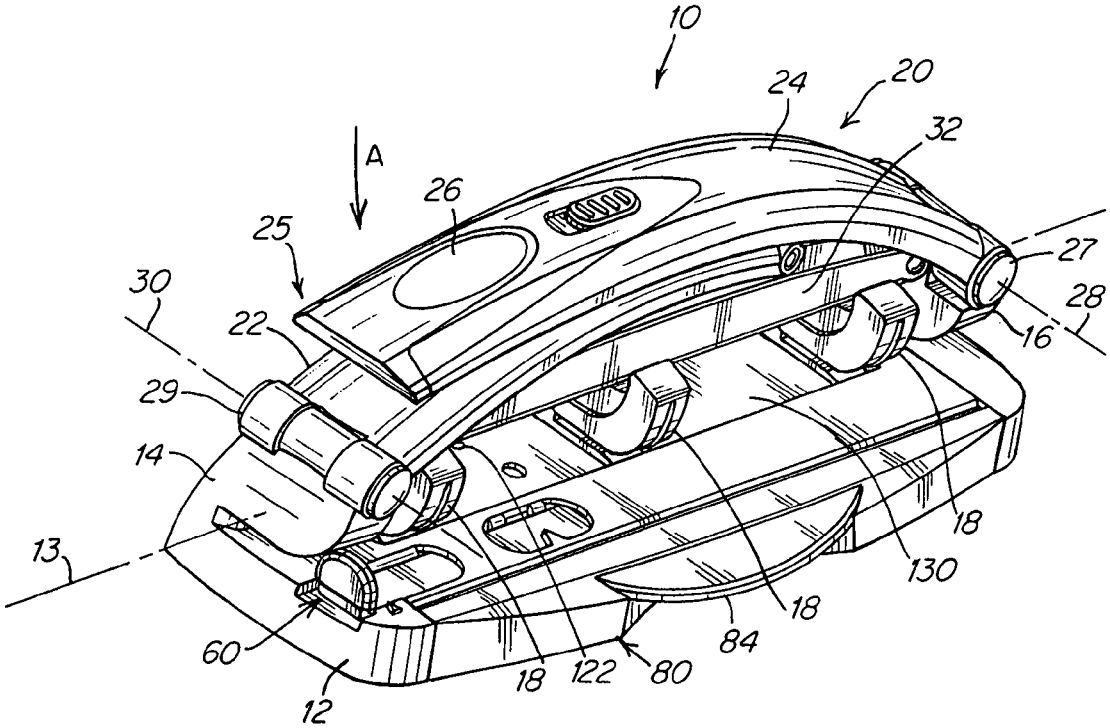
FIG. 1 is a perspective front view of an illustrative embodiment of a hole punch, shown in a closed position.

This invention is not limited in its application to the details of construction and the arrangement of components set forth in the following description or illustrated in the drawings. The invention is capable of other embodiments and of being practiced or of being carried out in various ways. Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

Aspects of the invention are described below with reference to illustrative embodiments. It should be understood that reference to these illustrative embodiments is not made to limit aspects of the invention in any way. Instead, illustrative embodiments are used to aid in the description and understanding of various aspects of the invention. Therefore, the following description is intended to be illustrative, not limiting.

Broadly, aspects of the present invention are directed to hole punches constructed in a manner whereby a balance is struck between the overall size (whether in use or in a storage mode) of the hole punch and the actuation force required to punch the holes. In this regard, the efficiency with which holes can be punched through the sheet or sheets of paper, while maintaining a sleek and low profile hole punch is provided.

In one embodiment, the hole punch includes a base having a longitudinal axis, with the base having first and second ends, and a lever arrangement joined to the base. The pivot axes of the levers are substantially perpendicular to the longitudinal axis. One of the levers overlies and engages the other and may include a free-end such that applying a force on the free-end causes the lever to pivot in one direction which then presses on the other lever causing it to pivot in an opposite direction. The two levers are coupled to a third lever or bar element which then presses on punch heads.

In one embodiment, the hole punch includes a lock to hold the lever arrangement in a closed or partially closed position, thereby reducing the envelope of the hole punch. In this stowed position, in one embodiment, the lock is disposed on one lever whereby a hook slidingly engages a pocket on the other lever. Other suitable locking arrangements may be employed, as the present invention is not limited in this respect.

Other features may be included in illustrative embodiments. In one embodiment, the hole punch includes a waste drawer slidingly received relative to the base and positionable beneath the punch head to capture a resulting chad after paper is punched. In one embodiment, the hole punch includes a slide rule to aid with alignment of a sheet of paper relative to the punch heads. The slide rule has a first portion slidingly engaged in the base and a second, upstanding portion. The upstanding portion may include a cover or otherwise be overmolded with a plastic material. To aid with sheet insertion, the punch heads may include a generously radiused entry. In one embodiment, the sheet-entry surface has a lead-in radius of approximately 11 mm. However, other suitable lead-in radii may be employed, as the present invention is not limited in this respect.

It should be appreciated that various combinations of the above-described features can be employed together; however the invention is not limited in this respect. Therefore, although the specific embodiments disclosed in the figures and described in detail below employ particular combinations of the above-discussed features, it should be appreciated that the present invention is not limited in this respect, as the various aspects of the present invention can be employed separately, or in different combinations. Thus, the particular embodiments described in detail below are provided for illustrative purposes only.

Figure 1A:
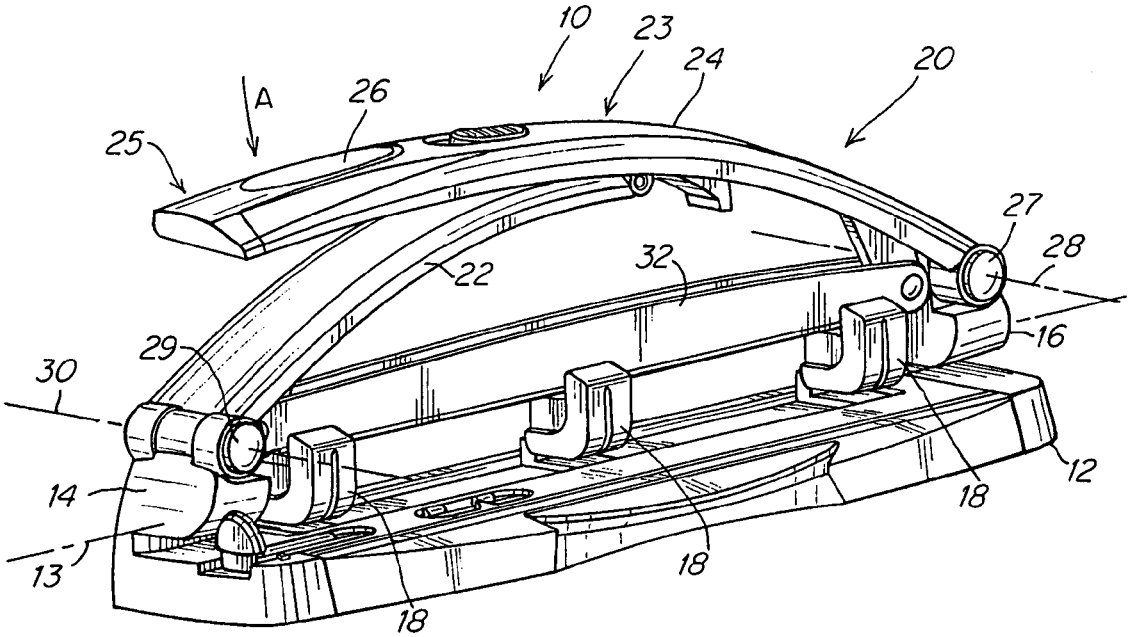
FIG. 1*a* is a perspective front view of the hole punch of FIG. 1, shown in an open position.
Figure 2:
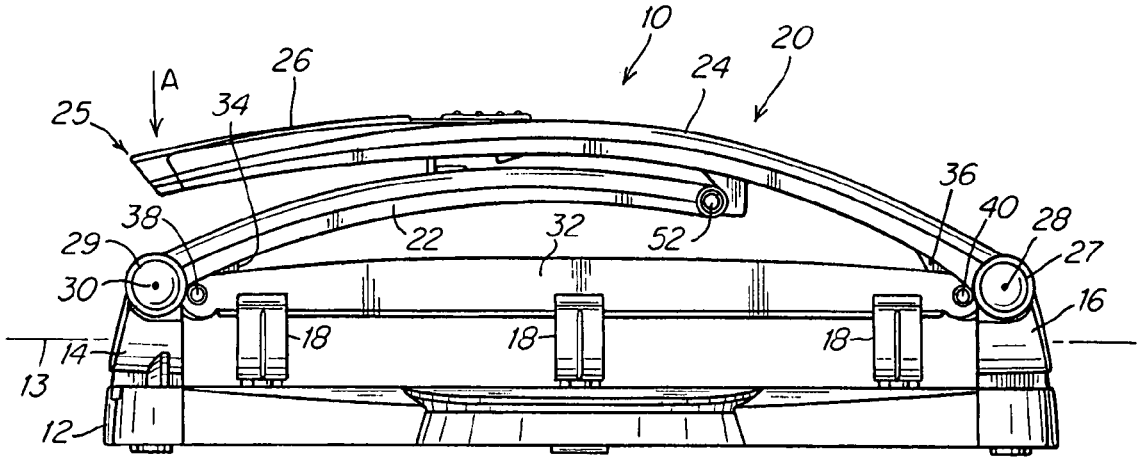
FIG. 2 is a front view of the hole punch shown in FIG. 1.

Turning now to the figures, and in particular, to FIGS. 1, 1*a* and 2, a hole punch 10 according to one embodiment of the present invention is shown. The hole punch 10 includes a base 12 having a longitudinal axis 13 running lengthwise relative to the base. The base also includes upstanding end portions 14, 16, a plurality of punch heads 18 and a lever system 20 to activate the punch heads. The lever system 20 includes a first lever arm 22 pivotally joined to the upstanding end portion 14, and a second pivotal arm 24 pivotally joined to the opposite upstanding portion 16 of the base. Each lever arm is pivotally connected via hinges 27, 29, to the end portions in a manner such that their respective pivot axes 28, 30 are substantially perpendicular to the longitudinal axis 13 of the base 12.

Levers 24 and 22 are arranged in a manner such that lever 24 extends over lever 22. Lever 24 includes a second free end 25 extending beyond the engagement area (located generally at 23) of levers 22, 24 that can be handled by a user to actuate the hole punch. In this regard, upon pressing down on the palm area 26 of the lever 24 in a counterclockwise direction along arrow A, as shown in FIG. 1*a*, lever 24 rotates about pivot axis 28 and subsequently engages lever 22, causing it to rotate clockwise in FIG. 1*a* about pivot 30. As a result, the levers rotate from the pre-actuation or rest position of FIG. 1*a* to the closed or punch position shown in FIGS. 1 and 2.

In one embodiment, lever system 20 also includes a third lever 32, with its ends respectively engaging levers 22, 24, and also engaging the punch head 18. The engagement between levers 22, 24 and lever 32 is such that downward rotation of the levers 22, 24 causes downward motion of lever 32 onto the punch heads. As will be discussed in greater detail, actuation of the punch heads via the lever 32 causes punches within the punch heads to pierce though one or more sheets of paper (not shown). In this regard, the punch moves from a rest position to a deployed position upon actuation of the free end of the second lever.

Figure 4:
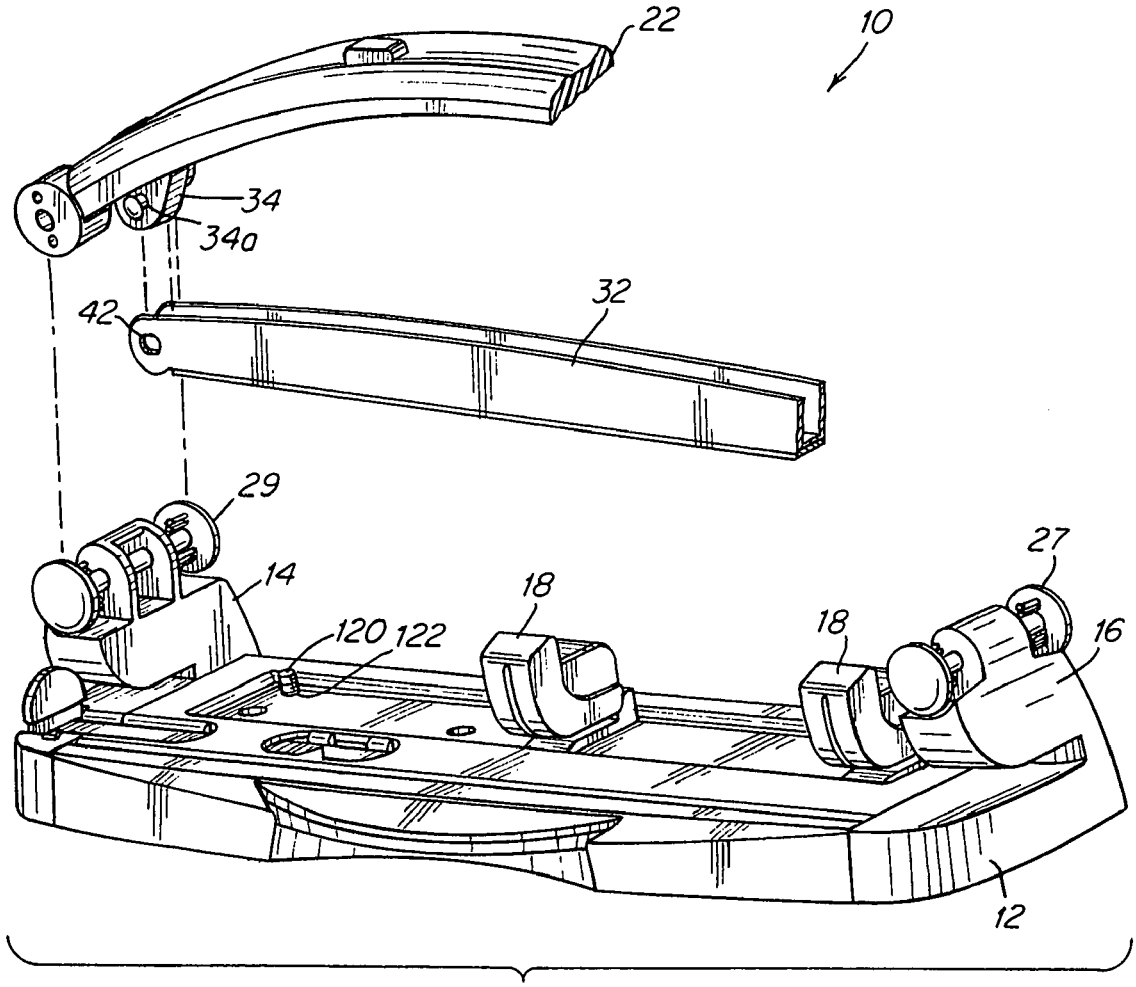
FIG. 4 is a partial exploded perspective view of an illustrative embodiment of a hole punch.
Figure 5:
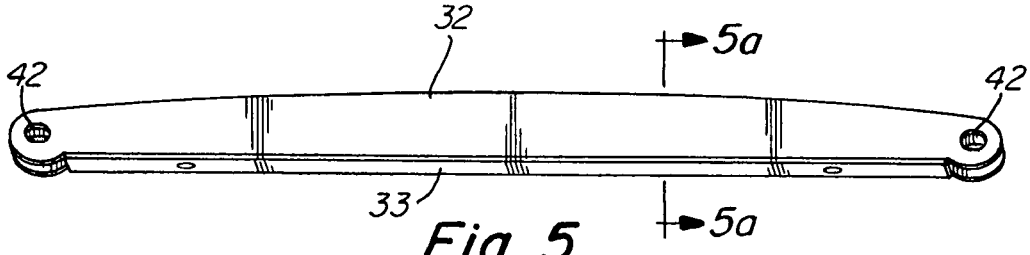
FIG. 5 is a perspective view of a lever of the hole punch of FIG. 1.

As best shown in FIG. 2, in one embodiment, the third lever 32 is coupled to each of the levers 22, 24 at end flanges 34, 36, respectively. In the embodiment shown, each flange engages the lever 32 via a pin connection 38, 40. As can be appreciated, the present invention is not limited in this regard, as other suitable connection arrangements may be employed. In the embodiment shown, however, because the lever arms 22, 24 are hinged to the base 12, linear motion of the pins 38, 40 relative to the lever arm 36 must occur to avoid binding the levers. Accordingly, as best shown in FIGS. 4 and 5, the receiving holes 42 of the lever arm 32 are elongated so as to form a slot. In this manner, the lever arm 32 is able to slide relative to the pin connection 38, 40 as the lever arms rotate. Each flange 34, 36 includes a hole 34*a*, 36*a* to receive a pin 38, 40. It should be appreciated that the present invention is not limited in this regard, as other suitable connections may be employed. For example, rather than a pin 38, 40, the flange may include a detent to snap into the hole in the bar 32.

Figure 5A:
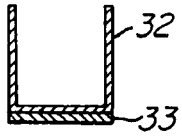
FIG. 5*a* is an enlarged, cross-sectional view of the lever of FIG. 5, taken along line 5*a*-5*a* of FIG. 5.

Turning now to FIGS. 4, 5 and 5*a*, lever 32 includes a U-shaped channel member. In the embodiment shown, lever 32 may be formed as a single piece of metal stamped in the shape shown; however, the present invention is not limited in this regard, as other suitable forming techniques may be employed, such as utilizing two or three separate pieces that are subsequently joined together via various joining techniques, such as welding.

In one embodiment, the lever is formed in a manner where the beam is taller in the central area than at the ends. This arrangement may reduce the amount of material and weight of the lever, while maintaining its structural integrity. However, the present invention is not limited in this respect, as the beam height may be uniform along its length. In one embodiment, as shown, the lever 32 includes a thicker bottom section 33, which may be integral with the material prior to forming or attached subsequently. In this manner, the thicker section may be better able to withstand the opposing force from the punch heads during use.

It should be appreciated that the present invention is not so limited. In this regard, lever 32 need not be formed in a U-shaped manner, as other suitable arrangements for rending the lever more rigid may be employed. Indeed, the lever may be formed as a solid piece.

Figure 6:
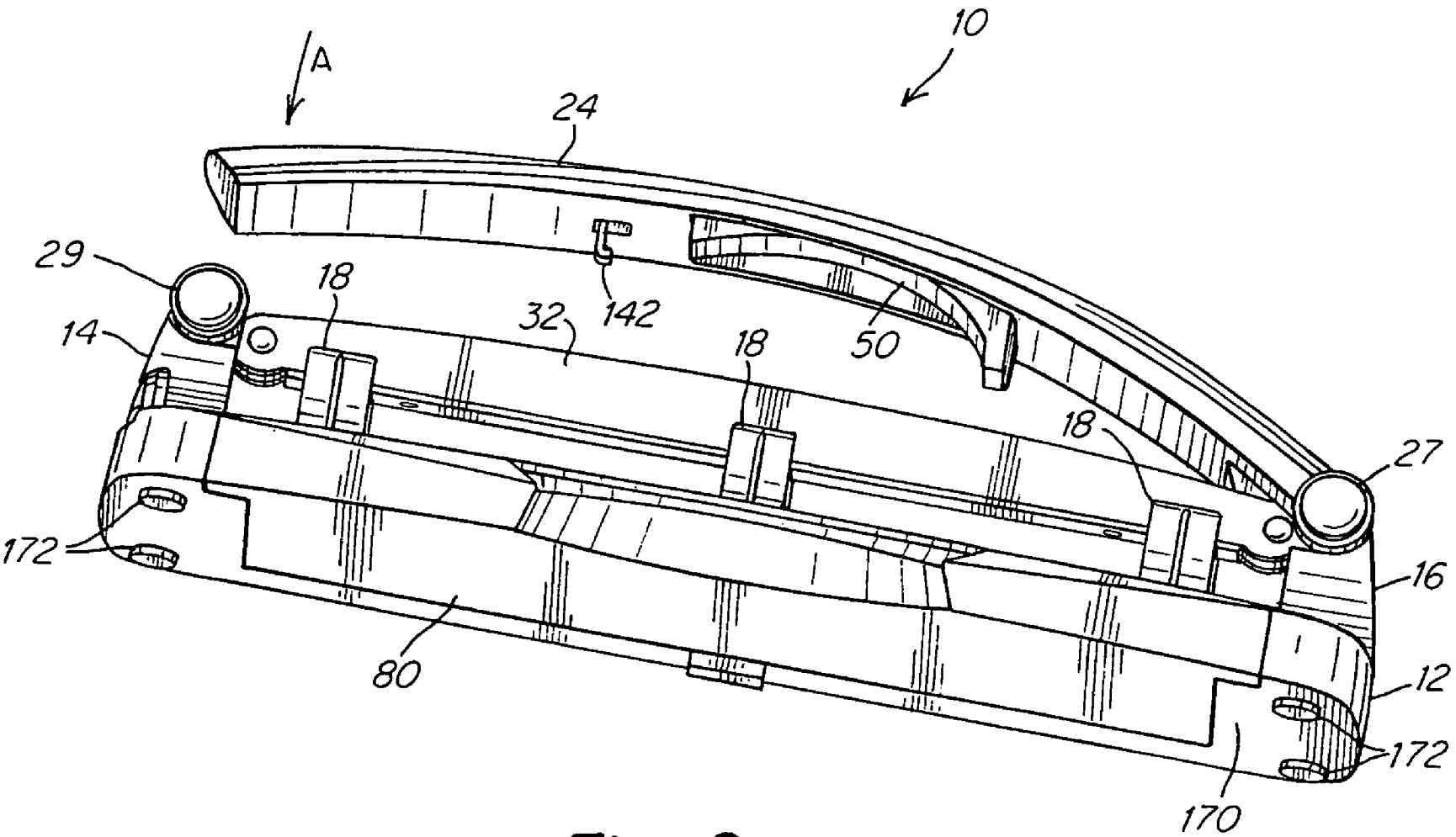
FIG. 6 is a partial perspective view showing an underside view of a lever of an illustrative hole punch.

As can be seen in the figures, the end of the lever 22 contacts the underside of lever 24 and about the mid-section 23 of lever 24. Contrasting FIGS. 1 and 1*a*, as lever 24 moves counterclockwise from the position shown in FIG. 1*a* to the position shown in FIG. 1, the end of the lever 22 slides along the under surface of lever 24. In one embodiment, as best shown in FIG. 6, the underside surface of lever 24 includes a curved section 50, which interacts with the end of lever 22 (not shown in FIG. 6 for clarity). In this regard, a controlled motion of the lever 22 to the closed position can be accomplished in that the radius of curvature of the curved surface 50 corresponds to the motion of the end of the lever 22 as it rotates about hinge 29.

It should be appreciated that the present invention is not limited in this regard and that lever 24 may not include the underside curved surface 50. In addition, although the curved section 50 is shown integral with lever 24, the present invention is not limited in this regard as the curved surface may be formed as a separate member that is subsequently attached to the underside of lever 24.

Figure 3:
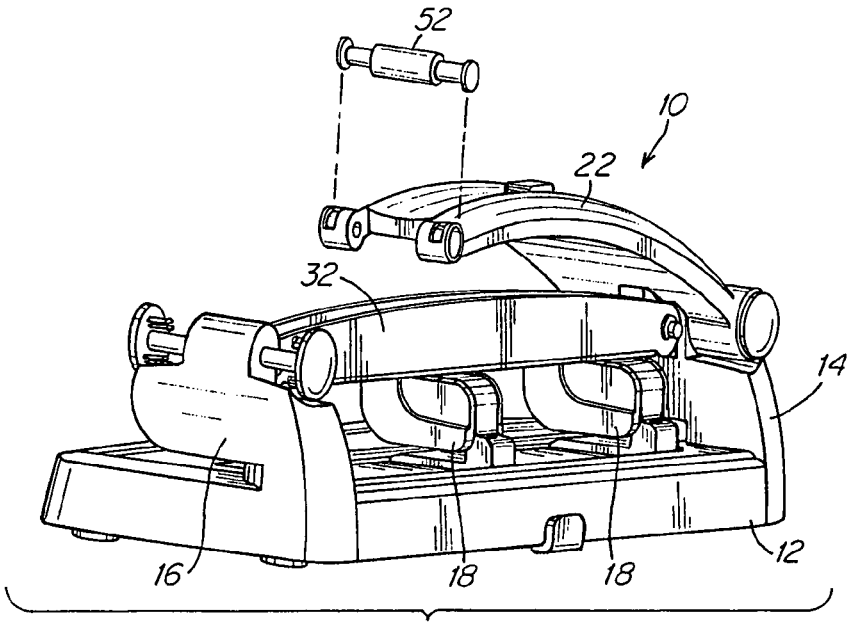
FIG. 3 is a partial exploded rear perspective view of the hole punch shown in FIG. 1.

To further facilitate smooth movement and operation of rotation of lever 22, in one embodiment, the end of the lever includes a roller bearing 52, as best shown in FIGS. 2 and 3 (Lever 24 has been removed in FIG. 3 for clarity). The roller bearing is free to rotate relative to the lever 22 such that a smooth and relatively frictionless motion occurs between the movement of lever 24 over lever 22. In the embodiment shown, the roller bearing 52 may be formed separate from the lever 22 and subsequently mounted thereto. It should be appreciated that the present invention is not limited in this regard and that the roller bearing need not be employed. For example, the end of the lever 22 may be coated with a material with a reduced coefficient of friction to allow sliding motion of the levers 24, 22 relative to each other as the hole punch is actuated.

Figure 7:
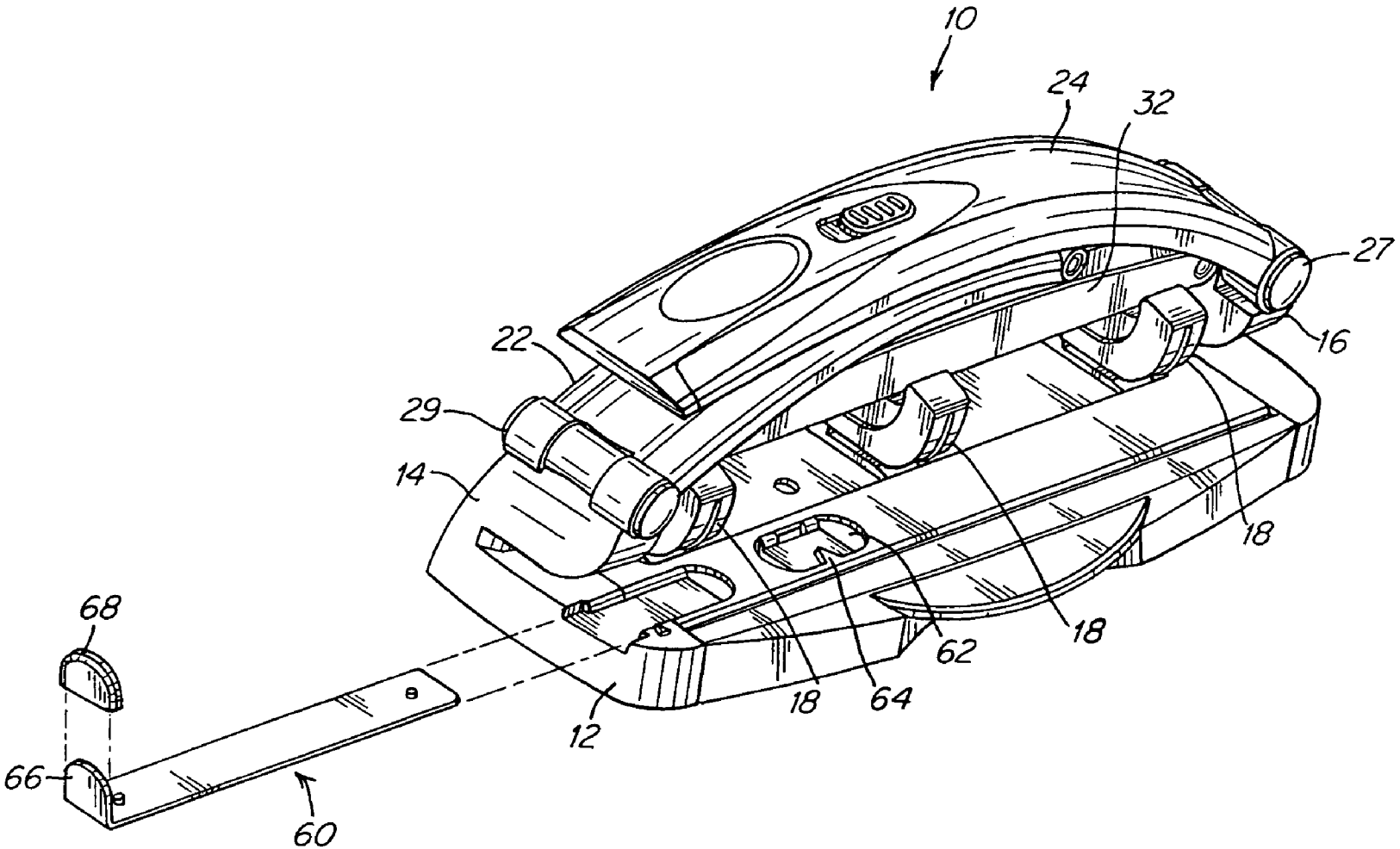
FIG. 7 is an exploded perspective view of an illustrative embodiment of a hole punch showing a slide rule.

To aid in aligning the paper to be punched relative to the punch heads so that the resulting holes in the paper are located in the desired position, a slide rule may be employed. In the embodiment shown in FIG. 7, the slide rule 60 fits within the base 12 and may be configured so as to slide along the base and be held in a desired position. The slide rule may be held in such a position through the use of a detent mechanism or merely by frictional engagement between the slide rule and the base. The slide rule may be infinitely adjustable along its length or may have preset positions at which it locks so that a user can simply move the slide rule to a desired corresponding position. Such a preset may be in the form of notches formed in the slide rule with a corresponding detent in the base to hold it in place. The slide rule itself may include demarcations (whether in inches or portions thereof, or centimeters or portions thereof) to indicate a corresponding dimensional position of the slide rule relative to the punch heads.

In one embodiment, the base includes a window 62 for viewing the slide rule. The base window 62 also includes a pointer 64 (in this illustrative embodiment shown in the shape of an arrow) that can be used to point to a section or demarcation line on the slide rule to allow a user to determine where the slide rule should be positioned.

In one embodiment, the slide rule includes up-turned end 66, as shown, to act as a buttress for the paper. This up-turned end 66 may include a cover 68. In one embodiment, the slide rule is formed of metal whereas the cover is formed of a thermoplastic material. The cover may be held in place with an adhesive or other suitable connection technique, as the present invention is not limited in this regard. In one embodiment, the cover may be formed on the slide rule during manufacture, such as during an overmold process. In this regard, the slide rule may be placed in a mold and a plastic material may be molded onto the end of the slide rule. In one embodiment, the overmolded material may be a thermoplastic material. However, as can be appreciated, the present invention is not limited in this respect as other suitable materials for the overmolded cover may be employed. In one embodiment, the cover material is thermal plastic elastomer (TPE).

Figure 8:
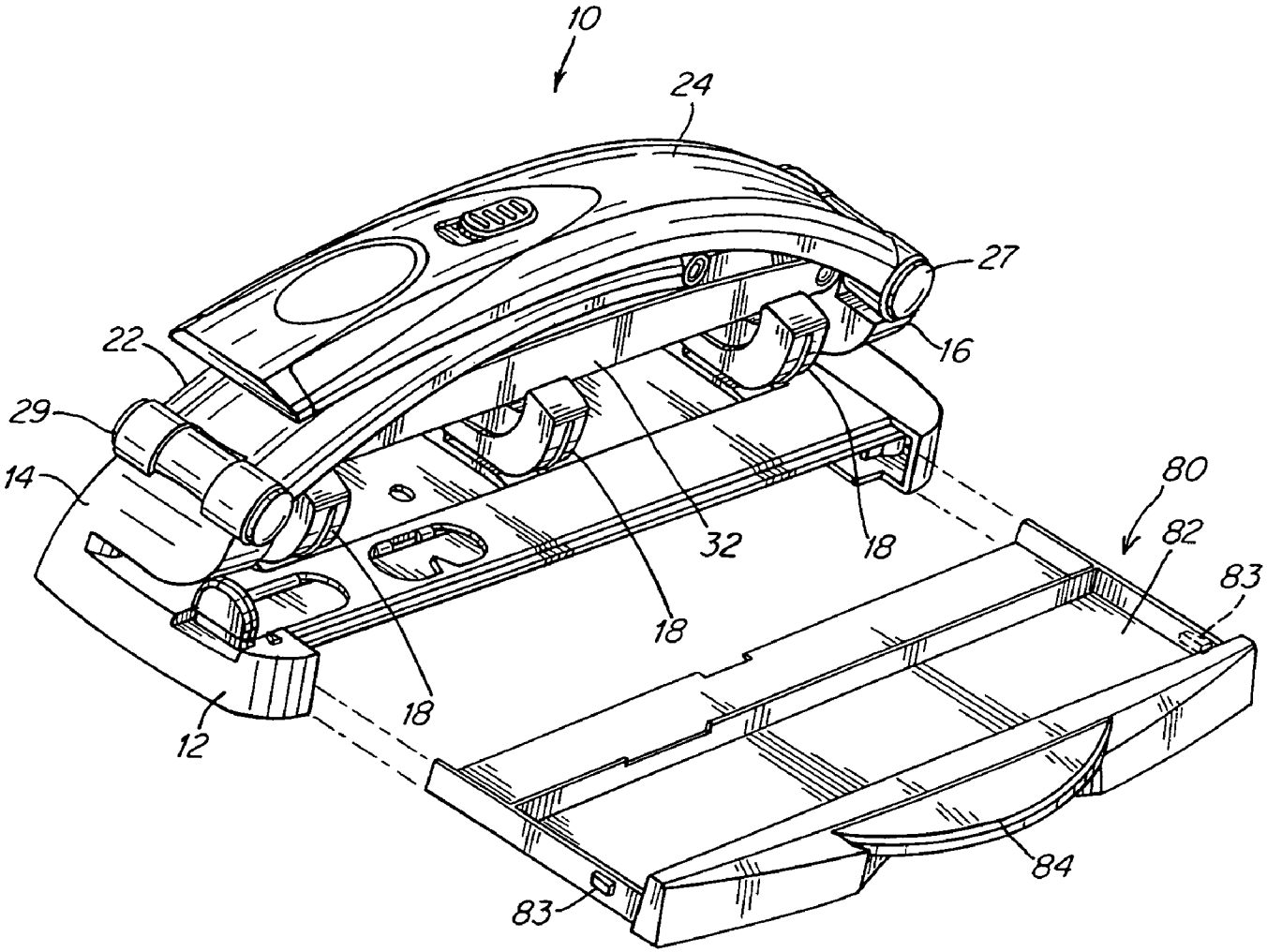
FIG. 8 is an exploded perspective view of another illustrative embodiment of the hole punch showing a waste drawer.

The hole punch may include features to capture the resulting punched paper from the hole after a sheet of paper has been punched. These resulting chads may be held within a waste container disposed below the punch heads. In one embodiment, as shown in FIG. 8, this waste container may be configured as a drawer 80 whereby the drawer slides laterally relative to the base 12. The waste drawer includes a chad receptacle 82 and may be held in the open or closed position with the use of suitable detents 83. The waste drawer includes a handle 84 to facilitate moving the waste drawer between the open and closed positions.

The drawer may be formed of a thermoplastic material, portions of which may be formed of a different material. For example, the receptacle 82 may be formed of a hard plastic material whereas the handle 84 may be formed of a softer material having greater frictional characteristics enabling it to be gripped with ease. For example, the receptacle 82 may be formed of a polypropylene while the handle 84 may be formed of a thermal plastic elastomer (TPE) of a less durometer.

Although a waste drawer is employed, the present invention is not limited in this regard, as other suitable receptacles may be employed. In addition, no receptacle need be employed and the chads may simply be expelled from the hole punch.

Figure 9:
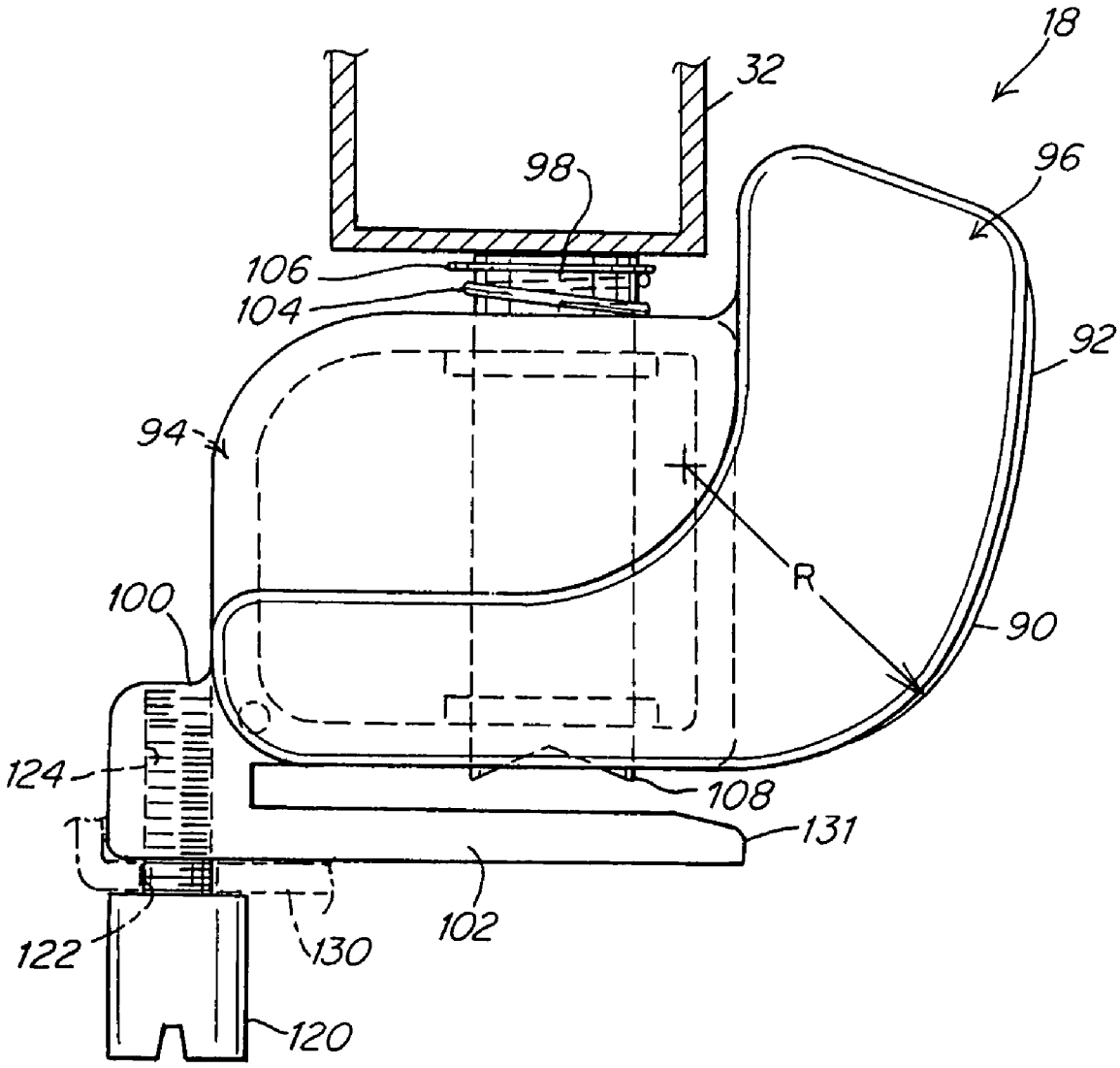
FIG. 9 is a side view of a punch head of a hole punch according to one illustrative embodiment.

As can be seen in FIG. 1, items to be punched are inserted into the hole punch by placing the item beneath the punch heads 18. In prior hole punches, the paper entry was oftentimes inhibited because the sheet would not easily slip beneath the punch heads. To alleviate this deficiency, in one embodiment, the punch heads include a lead-in surface 90 formed with a relatively large lead-in radius of curvature R, as shown in FIG. 9, allowing the sheet material to be funneled into position beneath the punch. In one embodiment, the radius of curvature R is approximately 11 mm. However, the present invention is not limited in this regard, as the radius of curvature may be larger or smaller as desired. As such, in another embodiment, the radius of curvature R is approximately 12 mm, and in yet another embodiment of the invention, the radius of curvature R is approximately 10 mm. In one embodiment, the radius of curvature R is any radius between approximately 9.5 mm and approximately 12.5 mm.

Also as shown in FIGS. 1 and 9, the lead-in surface 90 includes a reduced surface contact area, namely, knife edge 92, that engages first with the sheet material as the sheet material is being funneled beneath the punch heads. This knife edge may aid in positioning the sheet material. It should be appreciated that a knife edge need not be employed, as the present invention is not limited in this respect.

The punch head may be formed of any suitable material as the present invention is not limited in this regard. In one embodiment, the punch head is at least partially formed of a low friction material, thereby allowing for further ease of entry of the sheet material. In one embodiment, the punch head is formed of a metallic material that may be coated with a low friction material. In still other embodiments, the punch head may be formed of a durable plastic material. Combinations of materials are also contemplated, as the present invention is not limited in this respect.

Figure 9A:
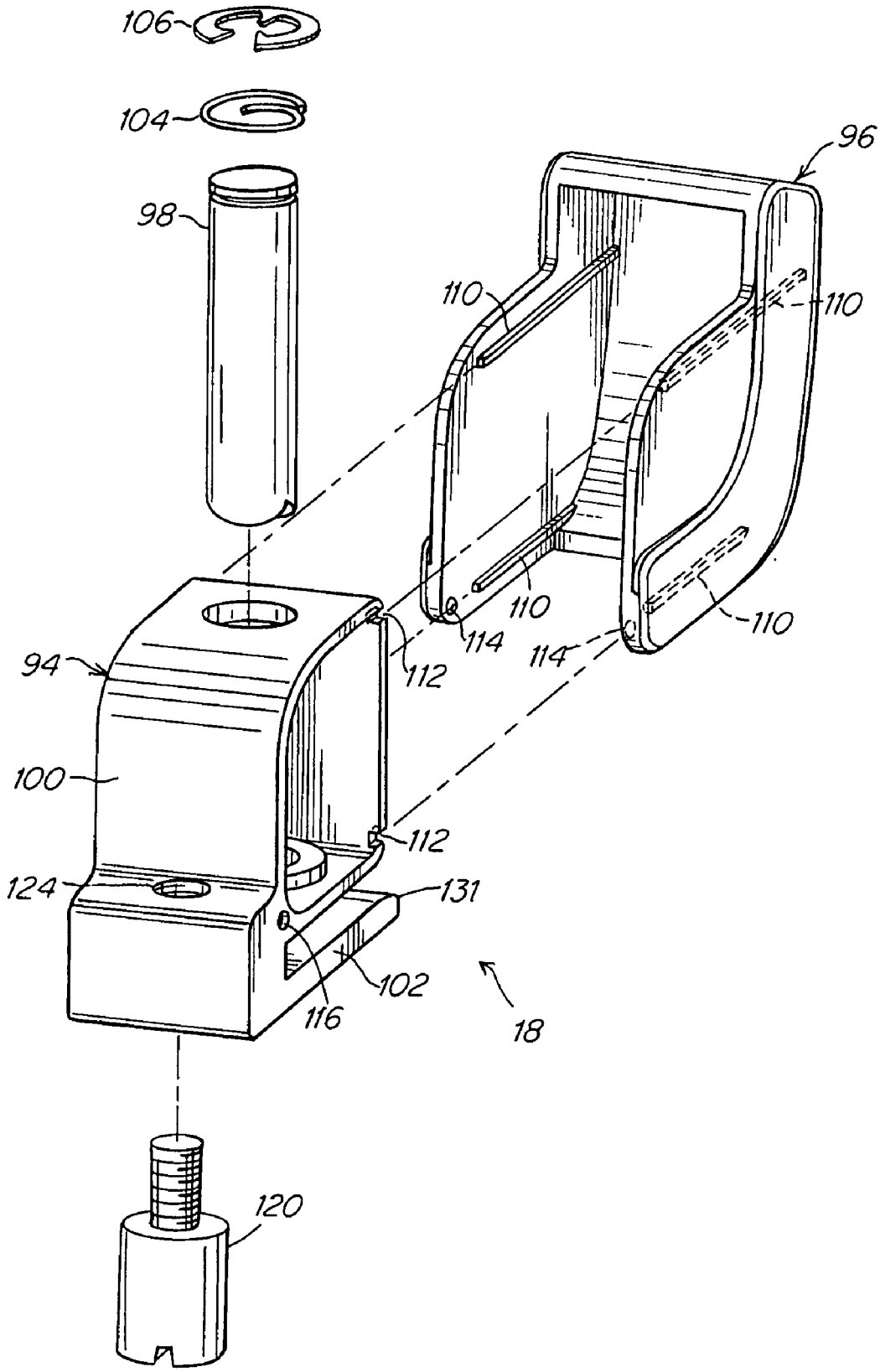
FIG. 9*a* is an exploded partial rear perspective view of the punch head of FIG. 9.

Referring in particular to FIGS. 9 and 9*a*, in one embodiment, the punch head 18 includes a frame 94, a separate cover 96 and a punch 98. The frame 94 includes a housing portion 100 and a foot 102. A spring 104, which is held on the punch 98 via a clip 106, biases the punch 98 toward the bar 32 when in a rest position. Upon actuation of the hole punch, as explained above, the bar 32 moves downward to force the punch 98 against the bias of the spring 104 from its rest position, thereby deploying the cutting end 108 of the punch 98 through the end of the housing 100 toward the foot 102 to pierce through the sheet material.

As shown in the exploded perspective view of FIG. 9*a*, the cover 96 slides onto the frame 94 via rails 110 formed on both sides of the cover and guides 112 formed on both sides of the frame. The cover is held in place via a detent arrangement including nubs 114 formed on each side of the cover and recesses 116 formed on each side of the housing. In one embodiment, the cover is formed of a plastic material whereas the frame is formed of a metal material; however, the present invention is not limited in this regard as any suitable materials may be employed.

As is conventional, the punch 98 is formed so as to produce a circular hole. However, the shape of the cutting end 108 may be any desired shape, as the present invention is not limited in this regard. For example, the cutting end 108 may have a cross section in the shape of a polygon, such as, a square, a rectangle, or a triangle, or other shapes, such as an oval, a star, or a heart. Other desired shapes may be employed.

The punch heads are fixed to the base, in one embodiment, via a screw 120. In this regard, the base includes a hole 122 (see FIGS. 1, 4 and 9) through which the screw passes and engages with a threaded hole 124 in the frame of the punch head. Of course, other suitable attachment arrangements may be employed, such as a fastener-free manner as a detent mechanism, as the present invention is not limited in this respect.

The hole punch 10 may be configured such that the spacing between the holes produced in the item to be punched is fixed; however, the present invention is not limited in this regard as the punch heads may be adjustable relative to the base. In one embodiment, the base includes a series of mounting areas including a plurality of spaced apart mounting holes 122. A user need only unscrew screw 120, relocate the punch head 18 to the new position over one of the other mounting holes 122 in the base and thereafter reattach the punch head by screwing it to the base. Although a mounting hole is shown and described, the present invention is not limited in this regard, as one or more mounting slots may be employed, allowing for a greater degree of adjustability.

Although the hole punch may allow a user to adjust the spacing of the resulting holes on the sheet material to be punched, not all punch heads need be adjustable. In this regard, in one embodiment, the two punch heads at either end of the hole punch may be fixed whereas the center punch head may be adjustable to two or more positions. Referring to FIG. 1, the end punch heads are fixed whereas the center punch head can be relocated over mounting holes 122 through the base 12.

In one embodiment, the base 12 includes a channel 130 (see FIG. 1) to slidingly receive the foot 102 of the punch head. In this manner, the leading edge 131 of the foot 102 of the punch head does not interfere with the sheet to be inserted.

Figure 10:
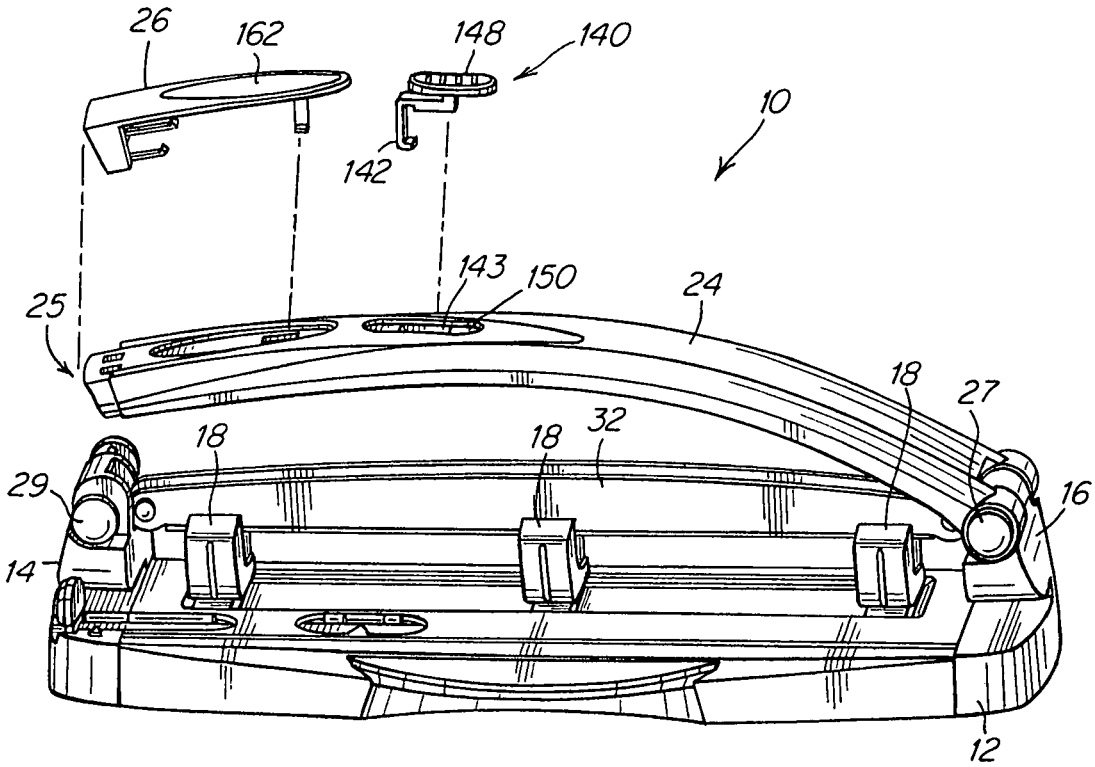
FIG. 10 is an exploded partial front perspective view of an illustrative embodiment of a hole punch.
Figure 11:
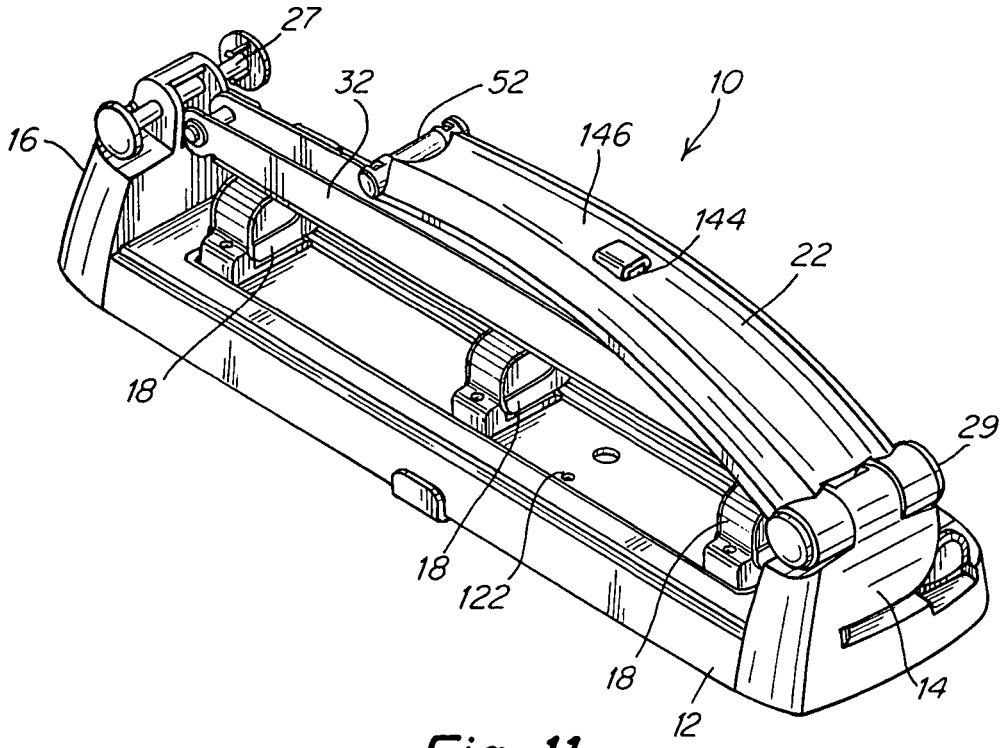
FIG. 11 is a rear partial perspective view of an illustrative embodiment of a hole punch.

Turning now to FIGS. 10 and 11, according to one embodiment of the invention, the hole punch 10 includes a lock 140 to hold the second lever 24 to the first lever 22 (not shown in FIG. 10 for clarity) in a stowed position. The stowed position need not necessarily be the completely closed position but rather it can be a position between the open (or pre-actuation) position and the closed (or punch) position, as the present invention is not limited in this respect. In a preferred embodiment, the stowed position of the lever system 20 is the closed position.

The lock 140 may be disposed on the second lever 24 and includes a hook 142 that extends through an opening 143 in the second lever 24 to engage with the first lever 22. In particular, as shown in FIG. 10, the hook 142 is disposed through an opening 143 in the second lever 24 and engages a pocket 144 formed on the upper surface 146 of the first lever 22. To move the lock 140 to the closed position where the hook 142 engages the pocket 144 and to an open position where the hook is free of the pocket, a slide member 148 is attached to the hook 142. When assembled, the slide member is positioned within a recess 150 formed in the second lever so as to maintain a low profile design.

The slide member 148 may be formed with a surface having ribs or knurls and may be curved, as shown, to accommodate a user's finger, such as a thumb, to move the lock into the desired position. The slide member may be formed of any suitable material as the present invention is not limited in this regard. In one embodiment, the slide member is formed of a plastic material whereas the hook is formed of a metal material. In addition, the slide member may be formed with an increased friction surface to facilitate gripping, and in one embodiment, the slide member is formed of thermal plastic elastomer (TPE).

Also as shown in FIG. 10, the hole punch 10 may include a palm engaging surface 26 on the free end 25 of the second lever 24. In the embodiment shown, the palm engaging surface 26 is formed as a separate element that can be snapped onto the free end of the lever. However, it should be appreciated that the present invention is not limited in this regard and the palm engaging area may be integrally formed in the free end of the handle. In addition, the palm engaging area may also include a surface portion 162 that is formed of a higher friction material such as thermal plastic elastomer (TPE). In addition, the grip area 162 may be overmolded onto the palm cover 26 or may be molded directly onto the free end of the handle as the present invention is not limited in this respect.

The underside 170 of the hole punch (see FIG. 6) may include rubber feet 172 to prevent marring and increase gripping of the surface on which the hole punch is used. The underside of the base may also be formed with a single sheet material formed of rubber to achieve the noted functions described above, instead of a plurality of individual feet, as the present invention is not limited in this respect.

As can be appreciated, the hole punch may be formed of any suitable material, as the present invention is not limited in this regard. Similarly, the hole punch may be sized to accommodate any number of sheets including one, five, ten, twenty, forty or more sheets. In this regard, the larger capacity hole punches may be formed with materials that are different than lighter-duty hole punches. In one embodiment, the base and the lever system is formed of metal, as is the punch head frame and punch itself. Other non-structural components may be formed of a lower strength material, such as plastic.

As mentioned above, some components of the hole punch may be formed of thermal plastic elastomer (TPE). To apply the TPE to its corresponding component, any suitable technique may be employed, such as co-molding or over molding in conjunction with injection molding, vacuum molding, blow molding, compression molding, transfer molding, extrusion, casting, and/or thermal forming. In one embodiment, the TPE material may be heated to its plastic-flow phase and injected or drawn via a vacuum into a mold in which the component to be overmolded was previously placed or formed. The TPE material may then be allowed to solidify about the component. In another embodiment, both the TPE material and the component material may be heated to a molten or plastic-flow phase and injected into a mold at substantially the same time and cooled substantially simultaneously or sequentially until both materials are solid and bonded together. In a further embodiment, the TPE material may be disposed on a preformed piece in a desired location and may be cut, molded, such as by heat molding, or otherwise shaped into a desired configuration. In some embodiments, the TPE material may form mechanical bonds, chemical bonds and/or other connections with the base component material.

It should also be appreciated that the hole punch need not be configured to punch spaced holes in a sheet so that the sheet can be inserted into a standard 3-ring binder; rather the punch head spacing may be altered by the user or the manufacturer, as desired, as described above, as the present invention is not limited in this respect. Similarly, aspects of the invention are not limited to employing three punch heads, as aspects of the invention may be employed on hole punches having one, two, three, four, five, six, seven, eight, nine, ten, or more punch heads. Also, the size and/or shape of the actual holes to be punched may be varied depending upon the desired use for the hole punch.

The foregoing written specification is to be considered to be sufficient to enable one skilled in the art to practice the invention. While the best mode for carrying out the invention has been described in detail, those skilled in the art to which this invention relates will recognize various alternative embodiments including those mentioned above as defined by the following claims. The examples disclosed herein are not to be construed as limiting of the invention as they are intended merely as illustrative of particular embodiments of the invention as enabled herein. Therefore, systems and methods that are functionally equivalent to those described herein are within the spirit and scope of the claims appended hereto. Indeed, various modifications of the invention in addition to those shown and described herein will become apparent to those skilled in the art from the foregoing description and fall within the scope of the appended claims.

What is claimed is:

1. A hole punch, comprising:

a base having a longitudinal axis, the base having a first end and a second end;

a first lever having a first end pivotally connected to the first end of the base, the first lever constructed and arranged to pivot about an axis that is substantially perpendicular to the longitudinal axis;

a second lever having a first end pivotally connected to the second end of the base and a second free end, the second lever constructed and arranged to pivot about an axis that is substantially perpendicular to the longitudinal axis, the second lever cooperating with the first lever such that actuation of the free end of the second lever causes the first lever to move;

a third lever having a first end operatively coupled to the first lever and a second end operatively coupled to the second lever; and at least one punch head mounted to the base, the punch head having a punch, with the third lever adapted to engage the punch and move the punch from a rest position to a deployed position upon actuation of the free end of the second lever.

2. The hole punch according to claim 1, wherein the first end of the third lever is connected to the first lever at location near the first end of the first lever and wherein the second end of the third lever is connected to the second lever at location near the first end of the second lever.

3. The hole punch according to claim 1, wherein the first and second ends of the third lever each comprises a slot, with the first lever and the second lever pinned to corresponding slot to allow sliding and pivoting motion of the third lever relative to the first and second levers.

4. The hole punch according to claim 1, wherein each of the first and second levers comprises a flange for coupling the first and second levers respectively to the third lever.

5. The hole punch according to claim 4, wherein each flange comprises a hole constructed and arranged to receive a pin, the pin coupling the flange to the third lever.

6. The hole punch according to claim 1, wherein the third lever is formed as a U-shaped channel member.

7. The hole punch according to claim 1, wherein the base comprises a first upstanding portion at the first end of the base and a second upstanding portion at the second end of the base, the first end of the first lever arm pivotally connected to the first upstanding portion, the first end of the second lever arm pivotally connected to the second upstanding portion.

8. The hole punch according to claim 1, wherein the first lever engages an underside of the second lever at approximately a mid section of the second lever.

9. The hole punch according to claim 8, wherein the underside of the second lever comprises a curved engagement surface.

10. The hole punch according to claim 1, further comprising a waste drawer slidingly received relative to the base and positionable beneath the at least one punch head to capture a resulting chad after paper is punched.

11. The hole punch according to claim 1, further comprising a slide rule constructed and arranged to aid with alignment of a sheet of paper relative to the punch heads, the slide rule having a first portion slidingly engaged in the base and a second, upstanding portion, the slide rule being formed of a first material, the upstanding portion comprising a cover formed of a second material that is different from the first material.

12. The hole punch according to claim 11, wherein the slide rule is formed of metal and the cover is formed of an overmolded thermoplastic material.

13. The hole punch according to claim 1, wherein the at least one punch head comprises a sheet-entry surface having a radius of approximately 11 mm.

14. The hole punch according to claim 1, wherein the first and second levers are movable from a pre-actuation position to a punch position, wherein the hole punch further comprises a lock constructed and arranged to engage with the first and second levers to hold the levers in a stowed position located at or between the pre-actuation position and the punch position.

15. The hole punch according to claim 14, wherein the lock is disposed in the second lever, the lock having a hook constructed and arranged to be selectively engageable with a pocket in the first lever upon actuation of the lock.

16. A hole punch, comprising:

a base having a longitudinal axis, the base having a first end and a second end;

a lever system movable from a pre-actuation position to punch position, the lever system comprising:

a first lever having a first end pivotally connected to the first end of the base, the first lever constructed and arranged to pivot about an axis that is substantially perpendicular to the longitudinal axis; and a second lever having a first end pivotally connected to the second end of the base and a second free end, the second lever constructed and arranged to pivot about an axis that is substantially perpendicular to the longitudinal axis, the second lever cooperating with the first lever such that actuation of the free end of the second lever causes the first lever to move;

at least one punch head having a punch and mounted to the base and operatively coupled to the lever system such that upon actuation of the lever system, the punch moves from a rest position to a deployed position;

a lock operatively coupled to the lever system, the lock constructed and arranged to engage with the first and second levers to hold the levers in a stowed position located at or between the pre-actuation position and the punch position;

wherein the lock is disposed in the second lever, the lock having a hook constructed and arranged to be selectively engageable with a packet in the first lever upon actuation of the lock; and a slide rule constructed and arranged to aid with alignment of a sheet of paper relative to the punch heads, the slide rule having a first portion slidingly engaged in the base and a second, upstanding portion, the slide rule being formed of a first material, the upstanding portion comprising a cover formed of a second material that is different from the first material.

17. The hole punch according to claim 16, wherein the slide rule is formed of metal and the cover is formed of an overmolded thermoplastic material.

18. The hole punch according to claim 16, wherein the lock further comprises a slide member coupled to the hook.

19. The hole punch according to claim 18, wherein the slide member comprises a surface that is constructed and arranged to be engaged with a finger of a user to move the hook into the desired position.

20. The hole punch according to claim 18, wherein in the slide member is positioned on the second lever and the hook is disposed through the second lever.

21. The hole punch according to claim 16, wherein the first lever comprises a pocket constructed and arranged to receive the hook.

22. The hole punch according to claim 18, wherein the second lever comprises a recess on an outer surface thereof, with the slide member being disposed at least partially within the recess.

23. The hole punch according to claim 16, further comprising a waste drawer slidingly received relative to the base and positionable beneath the at least one punch head to capture a resulting chad after paper is punched.

24. A hole punch, comprising:

a base having a longitudinal axis, the base having a first end and a second end;

a lever system movable from a pre-actuation position to punch position, the lever system comprising:

a first lever having a first end pivotally connected to the first end of the base, the first lever constructed and arranged to pivot about an axis that is substantially perpendicular to the longitudinal axis; and a second lever having a first end pivotally connected to the second end of the base and a second free end, the second lever constructed and arranged to pivot about an axis that is substantially perpendicular to the longitudinal axis, the second lever cooperating with the first lever such that actuation of the free end of the second lever causes the first lever to move;

at least one punch head having a punch and mounted to the base and operatively coupled to the lever system such that upon actuation of the lever system, the punch moves from a rest position to a deployed position;

a lock operatively coupled to the lever system, the lock constructed and arranged to engage with the first and second levers to hold the levers in a stowed position located at or between the pre-actuation position and the punch position;

wherein the lock is disposed in the second lever, the lock having a hook constructed and arranged to be selectively engageable with a pocket in the first lever upon actuation of the lock; and wherein the at least one punch head comprises a sheet-entry surface having a radius of approximately 11 mm.

25. A hole punch, comprising:

a base having a longitudinal axis, the base having a first upstanding portion at a first end of the base and a second upstanding portion at a second end of the base;

a lever system movable from a pre-actuation position to punch position, the lever system comprising:

a first lever having a first end pivotally connected to the first upstanding portion, the first lever constructed and arranged to pivot about an axis that is substantially perpendicular to the longitudinal axis, the first lever having a first flange near the first end of the first lever;

a second lever having a first end pivotally connected to the second upstanding portion and a second free end, the second lever constructed and arranged to pivot about an axis that is substantially perpendicular to the longitudinal axis, the second lever having a second flange near the first end of the second lever, an underside surface of the second lever engaging the first lever such that actuation of the free end of the second lever causes the first lever to move; and a third lever having a first end connected to the first flange and a second end connected to the second flange; and at least one punch head mounted to the base, the punch head having a punch, with the third lever adapted to engage the punch and move the punch from a rest position to a deployed position upon actuation of the free end of the second lever; and a lock operatively coupled to the lever system, the lock comprising a hook disposed through the second lever and constructed and arranged to engage a pocket disposed on the first lever to hold the levers in a stowed position located at or between the pre-actuation position and the punch position.

26. The hole punch according to claim 25, wherein the first and second ends of the third lever each comprises a slot, with the first and the second flanges of the first and second levers pinned to a corresponding slot to allow sliding and pivoting motion of the third lever relative to the first and second levers.

27. The hole punch according to claim 25, further comprising a waste drawer slidingly received relative to the base and positionable beneath the at least one punch head to capture a resulting chad after paper is punched.

28. The hole punch according to claim 25, further comprising a slide rule constructed and arranged to aid with alignment of a sheet of paper relative to the punch heads, the slide rule having a first portion slidingly engaged in the base and a second, upstanding portion, the slide rule being formed of a metal and the upstanding portion comprising a cover formed of an overmolded thermoplastic material.

29. The hole punch according to claim 25, wherein the at least one punch head comprises a sheet-entry surface having a radius of approximately 11 mm.

30. The hole punch according to claim 25, wherein the lock further comprises a slide member coupled to the hook, wherein in the slide member is positioned on the second lever, and wherein the slide member comprises a surface that is constructed and arranged to be engaged with a finger of a user to move the hook into the desired position.

31. The hole punch according to claim 30, wherein the second lever comprises a recess on an outer surface thereof, with the slide member being disposed at least partially within the recess.

* * * * *